US010305185B2

(12) United States Patent
Gabriel et al.

(10) Patent No.: US 10,305,185 B2
(45) Date of Patent: May 28, 2019

(54) MULTIBAND ANTENNA

(71) Applicant: KATHREIN-Werke KG, Rosenheim (DE)

(72) Inventors: Roland Gabriel, Rosenheim (DE); Andreas Vollmer, Rosenheim (DE)

(73) Assignee: KATHREIN SE, Rosenheim (DE)

( * ) Notice: Subject to any disclaimer, the term of this patent is extended or adjusted under 35 U.S.C. 154(b) by 0 days.

(21) Appl. No.: 15/329,090

(22) PCT Filed: Jul. 24, 2015

(86) PCT No.: PCT/EP2015/067025
§ 371 (c)(1),
(2) Date: Jan. 25, 2017

(87) PCT Pub. No.: WO2016/012601
PCT Pub. Date: Jan. 28, 2016

(65) Prior Publication Data

US 2017/0271764 A1 Sep. 21, 2017

(30) Foreign Application Priority Data

Jul. 25, 2014 (GB) ..... 1413256.7

(51) Int. Cl.
*H01Q 5/40* (2015.01)
*H01Q 21/24* (2006.01)
(Continued)

(52) U.S. Cl.
CPC ..... *H01Q 5/40* (2015.01); *H01Q 1/246* (2013.01); *H01Q 1/38* (2013.01); *H01Q 1/521* (2013.01);
(Continued)

(58) Field of Classification Search
CPC ..... H01Q 5/40; H01Q 1/521; H01Q 15/22; H01Q 21/0025; H01Q 21/245; H01Q 21/12; H01Q 1/52; H01Q 21/24
See application file for complete search history.

(56) References Cited

U.S. PATENT DOCUMENTS 4,074,270 A * 2/1978 Kaloi ..... H01Q 1/521 343/700 MS
4,334,230 A 6/1982 Kane
(Continued)

FOREIGN PATENT DOCUMENTS

EP 2003728 12/2008
EP 2053692 4/2009
(Continued)

OTHER PUBLICATIONS

Examination Report issued in GB Application No. 1413256.7 dated Apr. 27, 2017.
(Continued)

*Primary Examiner* — Dameon E Levi
*Assistant Examiner* — Jennifer F Hu
(74) *Attorney, Agent, or Firm* — Dann, Dorfman, Herrell and Skillman; Stephen Eland

(57) ABSTRACT

An antenna device comprises a PCB support divided into at least first, second, third and fourth subsections, a plurality of receiver means including at least first receiver means for receiving telecommunications signals at least a first receiver frequency band and a second receiver frequency band, a second receiver means for receiving telecommunications signals with in a third receiver frequency band and a fourth receiver frequency band, and third receiver means for receiving telecommunications signals in a fifth receiver frequency band, a plurality of transmitter means including at least first transmitter means for transmitting telecommunications signals in at least a first transmitter frequency band
(Continued)

and a second transmitter frequency band, second transmitter means for transmitting telecommunications signals in a third transmitter frequency band and a fourth transmitter band, and at least a third transmitter means for transmitting telecommunications signals in a fifth transmitter frequency band. The first receiver means are arranged in the first subsection and are arranged to receive telecommunications signals in a first polarization, the second receiver means are arranged in the second support subsection to receive telecommunications signals in said second polarization, the first transmitter means are arranged in the third support, subsection to transmit telecommunications signals in a second polarization, and the second transmitter means are arranged in the fourth subsection to transmit telecommunications signals in said first polarization.

21 Claims, 7 Drawing Sheets

(51) Int. Cl.

| | |
|---|---|
| ***H01Q 1/52*** | (2006.01) |
| ***H01Q 21/28*** | (2006.01) |
| ***H01Q 1/24*** | (2006.01) |
| ***H01Q 1/38*** | (2006.01) |
| ***H01Q 15/22*** | (2006.01) |
| ***H01Q 21/00*** | (2006.01) |

(52) U.S. Cl.
CPC ..... *H01Q 15/22* (2013.01); *H01Q 21/0025* (2013.01); *H01Q 21/245* (2013.01); *H01Q 21/28* (2013.01)

(56) References Cited

U.S. PATENT DOCUMENTS

| | | | | |
|---|---|---|---|---|
| 5,223,848 | A * | 6/1993 | Rammos | H01Q 9/0407 343/700 MS |
| 8,164,525 | B2 * | 4/2012 | Park | H01Q 1/2266 343/702 |
| 2001/0007445 | A1 * | 7/2001 | Pankinaho | H01Q 1/243 343/844 |
| 2002/0018019 | A1 * | 2/2002 | Fourdeux | H01Q 21/065 343/700 MS |
| 2002/0122006 | A1 * | 9/2002 | Crawford | H01Q 1/22 343/702 |
| 2009/0135078 | A1 | 5/2009 | Lindmark et al. | |
| 2013/0088404 | A1 | 4/2013 | Ramachandran et al. | |
| 2013/0285852 | A1 * | 10/2013 | Teillet | H01Q 3/38 342/368 |
| 2014/0022131 | A1 | 1/2014 | Azulay et al. | |
| 2014/0197998 | A1 | 7/2014 | Govindasamy et al. | |
| 2015/0325928 | A1 * | 11/2015 | Chao | H01Q 21/30 343/727 |

FOREIGN PATENT DOCUMENTS

| | | |
|---|---|---|
| EP | 2408062 | 1/2012 |
| EP | 2565985 | 3/2013 |
| EP | 2790270 | 10/2014 |
| GB | 2198290 | 6/1988 |
| JP | 2010166316 | 7/2010 |
| JP | 1662070 | 3/2011 |
| TW | I415329 | 11/2013 |
| WO | 2007/092626 | 8/2007 |
| WO | 2013/064091 | 5/2013 |

OTHER PUBLICATIONS

GB Search Report issued in GB Application No. 1413256.7 dated Jan. 16, 2015.
International Search Report issued in International Application No. PCT/EP2015/067025 dated Oct. 29, 2015.

* cited by examiner

MULTIBAND ANTENNA

FIELD OF THE INVENTION

The disclosure relates to a multiband antenna device and a method for designing a multiband antenna device.

BACKGROUND TO THE INVENTION

The use of mobile communications networks has increased over the last decade. Operators of mobile communications networks have increased the number of base stations in order to meet an increased demand for service by users of mobile communications networks. The operators of mobile communications networks wish to reduce the running costs of respective base stations. One option to do this is to implement a radio system as an antenna-embedded radio forming an active antenna array. Many of the components of the antenna-embedded radio may be implemented on one or more chips.

Distributed antenna systems are known in the art. The distributed antenna system often employs single antenna elements to provide mobile communications systems throughout the indoor of buildings and also across campus-style environments. These distributed antenna systems are dynamic and can be quickly reconfigured to cope with changing mobile telecommunications traffic.

One example of such a distributed antenna system has been developed by Kathrein-Werke K G, Rosenheim, Germany and is marketed under the name "K-BOW". This system aggregates data traffic with a centralised platform and transmits multiple combinations of telecommunications signals to individual radio units (RUs) for transmission by individual radio units or single antenna elements. The system is remotely controlled using a network monitoring system, so that capacity in any area within the building or over the campus can be dynamically increased or decreased. The system uses a broadband amplifier in the individual radio units. The single antenna elements are able to broadcast signals using a plurality of frequencies.

US Patent U.S. Pat. No. 5,223,848 teaches an antenna comprising at least one pair of radiator elements with orthogonal linear polarisation. One of the radiator elements is fed with a signal with a phase difference of 90° relative to the signal fed to the other radiator element. Each of the radiator elements transmits and/or receives signals at two different frequencies having orthogonal polarisations. One of the radiator elements operates at a first frequency with a horizontal polarisation and a second frequency with a horizontal polarisation. The other radiator element operates at the first frequency with a horizontal polarisation and at the second frequency with a vertical polarisation.

Japanese Patent JP 4682979 B2 teaches an antenna, which is capable of duplexing cross-polarisation communication. Four antennas serving two frequencies are arranged in four sections with opposite orthogonal polarisation.

SUMMARY OF THE INVENTION

The present invention teaches an multiband antenna device comprising a mechanical support, preferably a PCB support, divided into at least first, second, third and fourth subsections, a plurality of receiver means including at least first receiver means with antenna for receiving telecommunications signals in at least a first receiver frequency band and a second receiver frequency band, a second receiver means with antenna for receiving telecommunications signals in a third receiver frequency band and a fourth receiver frequency band, and third receiver means with antenna for receiving telecommunications signals in a fifth receiver frequency band, a plurality of transmitter means including at least first transmitter means with antenna for transmitting telecommunications signals in at least a first transmitter frequency band and a second transmitter frequency band, second transmitter means with antenna for transmitting telecommunications signals in a third transmitter frequency band and a fourth transmitter band, and at least a third transmitter means with antenna for transmitting telecommunications signals in a fifth transmitter frequency band. The first receiver means are arranged in the first subsection and are arranged to receive telecommunications signals in a first polarisation, the second receiver means are arranged in the second support subsection to receive telecommunications signals in said second polarisation, the first transmitter means are arranged in the third support subsection to transmit telecommunications signals in a second polarisation, and the second transmitter means are arranged in the fourth subsection to transmit telecommunications signals in said first polarisation.

The present invention therefore teaches a multiband antenna device with oppositely located sectors with different polarisations, so that improved decoupling of the received and transmitted telecommunications signals can be achieved. The receiver means or the transmitter means are adapted to work with two frequency bands and may comprise a dual band receiver and/or a dual band transmitter, or may comprise two single band receivers and/or two single band transmitters. Furthermore, the receiver means or the transmitter means comprise at least one dual band antenna per individual ones of the receiver means or the transmitter means. The dual band antenna of this disclosure can be constituted by one broadband antenna or can be constituted by two single band antennas.

In an aspect of the present invention, the first and second polarisations are linear and orthogonal or at +/−45° to each other for decoupling of the telecommunications signals in different ones of the frequency bands or between the same frequency bands, both in the receiver and transmitter sections.

In an aspect of the invention, the first receiver means and the second receiver means are adapted to receive the telecommunications signals in the two same receiver frequency bands and the first transmitter means and the second transmitter means are adapted to transmit the telecommunications signals in the two same transmitter frequency bands. Hence, the two receiver means working in a same receiver frequency band have a different polarisation and/or a spatial separation. The two transmitter means working in a same transmitter frequency band have a different polarisation and/or a spatial separation. This arrangement provides MIMO capability, in particular 2*2 MIMO capability.

For M*M MIMO capability, the skilled person will appreciate that at least two multiband antenna devices as described above can be aggregated for providing further ones of the receive paths and the transmit paths in the respective frequency bands.

In another aspect of the invention, a third receiver means is arranged in two subsections of the at least first, second, third and fourth subsections, and the third transmitter means is arranged in other two subsections of the at least first, second, third and fourth subsections. The third receiver means and the third transmitter means may provide a different polarisation and/or a spatial separation with respect to each other and/or with respect to the other ones of the receiver means and the transmitter means for providing MIMO capability. None of the prior art documents cited in the introduction disclose a third receiver means.

The third receiver means can be arranged in both the first and second subsections, and the third transmitter means can be arranged in both the third and fourth subsections. Alternately, the third receiver means may be arranged in both the second and fourth subsections, and the third transmitter means may be arranged in both the first and third subsections.

In another aspect of the invention, the third receiver and the third transmitter means are arranged to work in different polarisation and/or spatial separation for signal decoupling of the telecommunication signals.

In an aspect of the invention, the first and third receiver means can be integrated in a dual or triple band receiver means, and/or the second and fourth receiver means are integrated in a dual or triple band receiver means. In particular, the antenna of the first and third receiver means can be made as a dual or triple band antenna, and/or the antenna of the second and fourth receiver means can be made as dual or triple band receiver means.

By providing dual or triple band receiver means, a compact design may be obtained. Filter losses may be kept low since two distant frequency bands may be diplexed with filters that do not necessarily have a high selectivity. Using the dual band configuration is beneficial for, but not is limiting of, MIMO applications by providing MIMO capability also in further frequency bands.

In an aspect of the invention, the receiver means and the transmitter means comprise dipoles and/or patch antennas.

In yet another aspect of the invention, the multiband antenna device comprises radiating elements forming single radiators for each receiver means and each transmitter means, and wherein said radiators comprise feeding lines for feeding the transmitter means and the receiver means. By providing the feeding lines on a PCB support, a very compact design can be achieved. Alternatively the feeding lines and the radiating elements can be implemented by using air microstrip line techniques. The use of a certain transmission line technique is not limiting to the invention.

In an aspect of the invention, the first receiver means is working in a frequency range of 1710-1785 MHz and the first transmitter means is working in a frequency range of 1805-1880 MHz, the second receiver means is working in a frequency range of 2500-2570 MHz and the second transmitter means is working in a frequency range of 2620-2690 MHz in transmission, the third receiver means is working in a frequency range of 1920-1980 MHz and the third transmitter means is working in a frequency range of 2110-2170 MHz In an aspect of the invention, each of the receiver means and each of the transmitter means comprise a narrowband antenna. The first, second and fifth receiver frequency bands comprise a lowest receiver frequency band, a second lowest receiver frequency band and a plurality of higher receiver frequency bands. The first, second and third transmitter frequency bands comprise a lowest transmitter frequency band, a second lowest transmitter frequency band and a plurality of higher transmitter frequency bands.

In a further aspect, for transmitter means located in only one subsection, the second lowest receiver frequency band is the fifth receiver frequency band and the second lowest transmitter band is the fifth transmitter frequency band. One of the first or second receiver means operates in a receiver frequency band below the fifth receiver frequency band and the other of the first or second receiver means operates in a receiver frequency band above the fifth receiver band. One of the first or second transmitter means operates in a transmitter frequency band below the fifth transmitter frequency band and the other of the first or second transmitter means operates in a transmitter frequency band above the fifth transmitter band In an aspect of the invention, a distance between two of the receiver means or the transmitter means with antennas relaying the telecommunications signals having the same polarization in the subsections is the size of one of the receiver means operating in the fifth receiver frequency band or the size of the transmitter means operating at the fifth transmitter frequency band. The size of the receiver or transceiver means is preferably defined by the dimensions of the respective antenna and/or the dimensions of the respective subsections of the multiband antenna device.

This positioning and matching of the transmitter frequency bands and the receiver frequency bands enables a high degree of isolation between the bands and low passive intermodulation.

The present invention also proposes multiband antenna devices divided into at least first, second, third and fourth subsections, arranging a plurality of receiver means including at least first receiver means for working in at least a first receiver frequency band and a second receiver frequency band, a second receiver means for working in at least a third receiver frequency band and a fourth receiver frequency band, and third receiver means for working in a fifth receiver frequency band, and arranging a plurality of transmitter means including at least first transmitter means for working in at least a first transmitter frequency band and a second transmitter frequency band, second transmitter means for working in at least a third transmitter frequency band and a fourth transmitter band, and at least a third transmitter means for working in a fifth transmitter frequency band. The first receiver means are arranged in the first subsection and the antenna of the first receiving means is arranged to receive telecommunications signals having a first polarisation, the second receiver means are arranged in the second support subsection and the antenna of the second receiving means receives telecommunications signals having a second polarisation, the first transmitter means are arranged in the third support subsection and the antenna of the first transmitting means transmits telecommunications signals having a second polarisation, and the second transmitter means are arranged in the fourth subsection and the antenna of the second transmitting means transmits telecommunications signals having a first polarisation.

The first receiver frequency band and the third receiver frequency band are arranged to be the same and the second receiver frequency band and the fourth receiver frequency band are arranged to be the same. The first transmitter frequency band and the third transmitter frequency band are arranged to be the same and the second transmitter frequency band and the fourth transmitter frequency band are arranged to be the same.

DETAILED DESCRIPTION OF THE INVENTION

The invention will now be described on the basis of the drawings illustrating preferred embodiments. It will be understood that the embodiments and aspects of the invention described herein are only examples and do not limit the protective scope of the claims in any way. The invention is defined by the claims and their references. It will be understood that features of one aspect or embodiment of the invention can be combined with a feature of a different aspects or aspects and/or embodiments of the invention.

Figure 1:
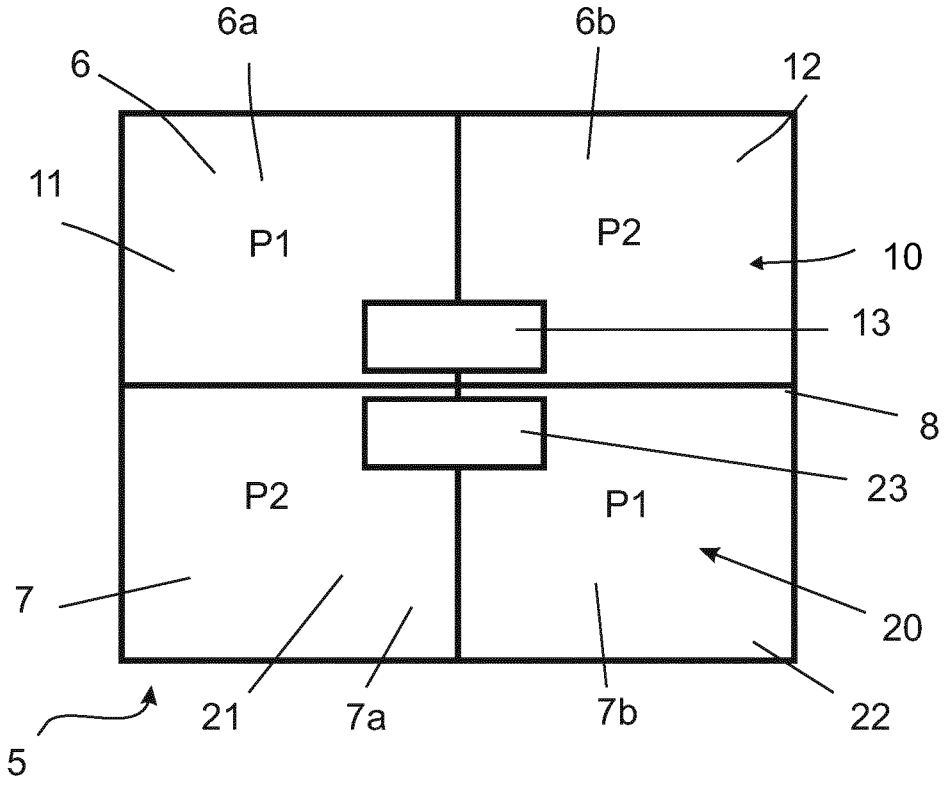
FIG. 1 shows a principle of an antenna arrangement according to an aspect of the disclosure.

FIG. 1 shows a principle of an antenna arrangement 1 according to an aspect of the disclosure.

The antenna arrangement 1 comprises an antenna support 5, divided into in a first support area 6 and a second adjacent support area 7, separated by a separation line 8. The antenna arrangement 1 is adapted to receive telecommunications signals by a receiver section 10 located in the first support area 6 and to transmit telecommunications signals by a transmitter section 20 located in the second support area 7.

The separation line 8 of the antenna arrangement 1 of FIG. 1 separates the antenna support 5 in an upper section and a lower section. The receiver section 10 is located on the upper side of the figure and the transmitter section 20 on the lower side on the figure. This arrangement is, however, not limiting the invention and the receiver section may be located on the lower side and the transmitter section on the upper side. Similarly, the separation line 8 may divide the antenna support 5 in two lateral sections, a left and right sections, with the receiver section located in the left section and the transceiver section ion the right section, or vice-versa.

The receiver section 10 comprises three receiver subsections 11, 12, 13. The first receiver subsection 11 is located in a first subsection 6*a* of the first support area 6 and has an antenna adapted to receive telecommunications signals having a first polarisation P1. The second receiver subsection 12 is located in a second subsection 6*b* of the first support area 6 and has an antenna adapted to receive telecommunications signals having a second polarisation P2. The third receiver subsection 13 is located both in the first subsection 6*a* and in the second subsection 6*b*, and has an antenna adapted to receive telecommunications signals having the two polarisations P1 and P2.

The transmitter section 20 comprises three transmitter subsections 21, 22, 23. The first transmitter subsection 21 is located in a first subsection 7*a* of the second support area 7 and has an antenna adapted to transmit telecommunications signals having the second polarisation P2. The second transmitter subsection 22 is located in a second subsection 7*b* of the second support area 6 and has an antenna adapted to transmit telecommunications signals having said first polarisation P1. The third transmitter subsection 23 is located both in the first subsection 7*a* and the second subsection 7*b*, and has an antenna adapted to transmit telecommunications signals in the two polarisations P1 and P2.

The first receiver subsection 11 faces the first transmitter subsection 21 for receiving telecommunication signals in the first polarisation P1 and transmitting of telecommunication signals in the second polarisation P2, at both a first and second frequency ranges F1 and F2.

The second receiver subsection 12 faces the second transmitter subsection 22 for receiving telecommunication signals in the second polarisation P2 and the transmitting of telecommunication signals in in the first polarisation P1, at both said first and second frequency ranges F1 and F2.

The third receiver subsection 13 faces the third transmitter subsection 23, for receiving and transmitting of telecommunication signals at the first or second polarisation P1 or P2.

Adjacent subsections in the same frequency range have their antennas adapted to receive or transmit the telecommunications signals in two orthogonal polarisations for decoupling of the telecommunications signals received in the two adjacent receiver subsections, or the signals transmitted in two adjacent transmitter subsections, or the received signal and transmitted signal in adjacent ones of the receiver subsection and the transmitter subsection. The polarisations can also be at +/−45°.

The skilled person will understand that the first and second receiver sections 11 and 12 and the first and second transmitter sections 21 and 22 may be used to implement MIMO capability. The first receiver section forms a first MIMO quadrant 11, the second receiver section forms a second MIMO quadrant 12, the first receiver section forms a third MIMO quadrant 21 and the second transmitter section 22, a fourth MIMO quadrant 22, respectively in this aspect of the disclosure. The remaining third receiver section 13 and transmitter section 23 are arranged in the space of the first MIMO quadrant 11 and the second MIMO quadrant 12 and respectively in the space of the third MIMO quadrant 21 and the fourth MIMO quadrant 22.

As will be described in the following, the antenna arrangement 1 comprises a plurality of narrow-band antennas, which share a common reflector. The narrow band antenna may comprise diverse single band antennas, as illustrated hereafter with reference to FIGS. 2 and 3. The narrow band antenna may also include a dual or multi band radiator, as illustrated in FIGS. 4 and 5. As will be seen, the narrow band antenna helps in having lower filter losses and passive intermodulation compared to traditional wide-band systems.

Figure 2:
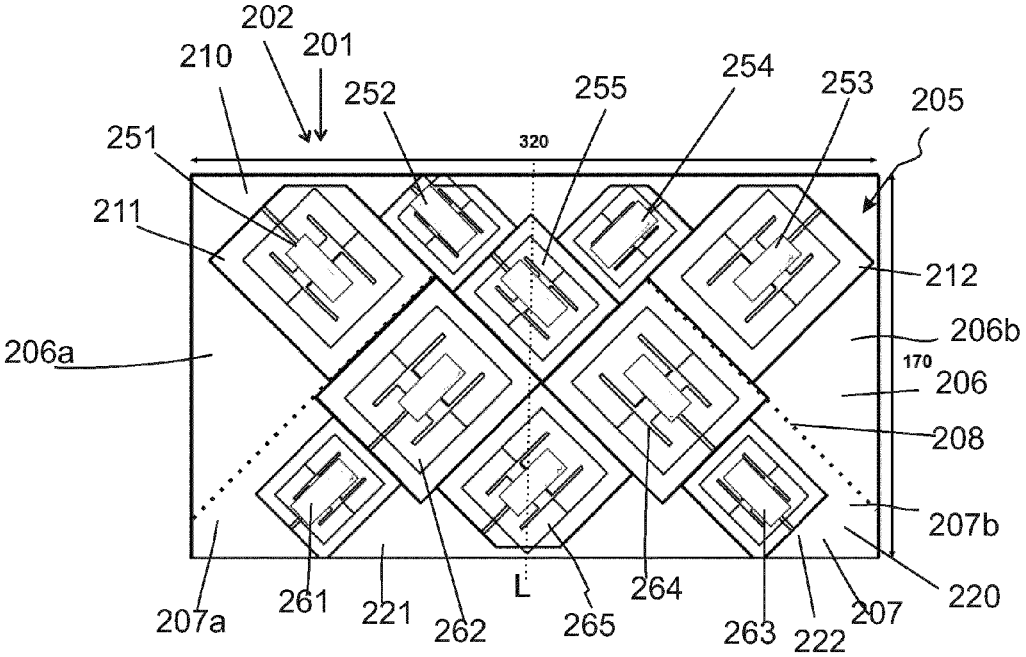
FIG. 2 shows an antenna device according to an aspect of the disclosure.
Figure 3:
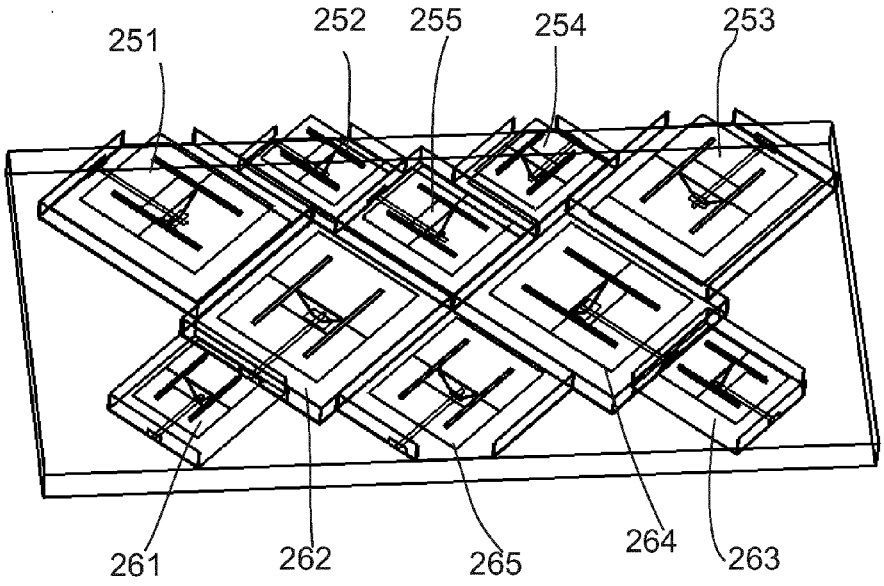
FIG. 3 shows the antenna device of FIG. 2 assembled on a PCB according to an aspect of the disclosure.
Figure 4:
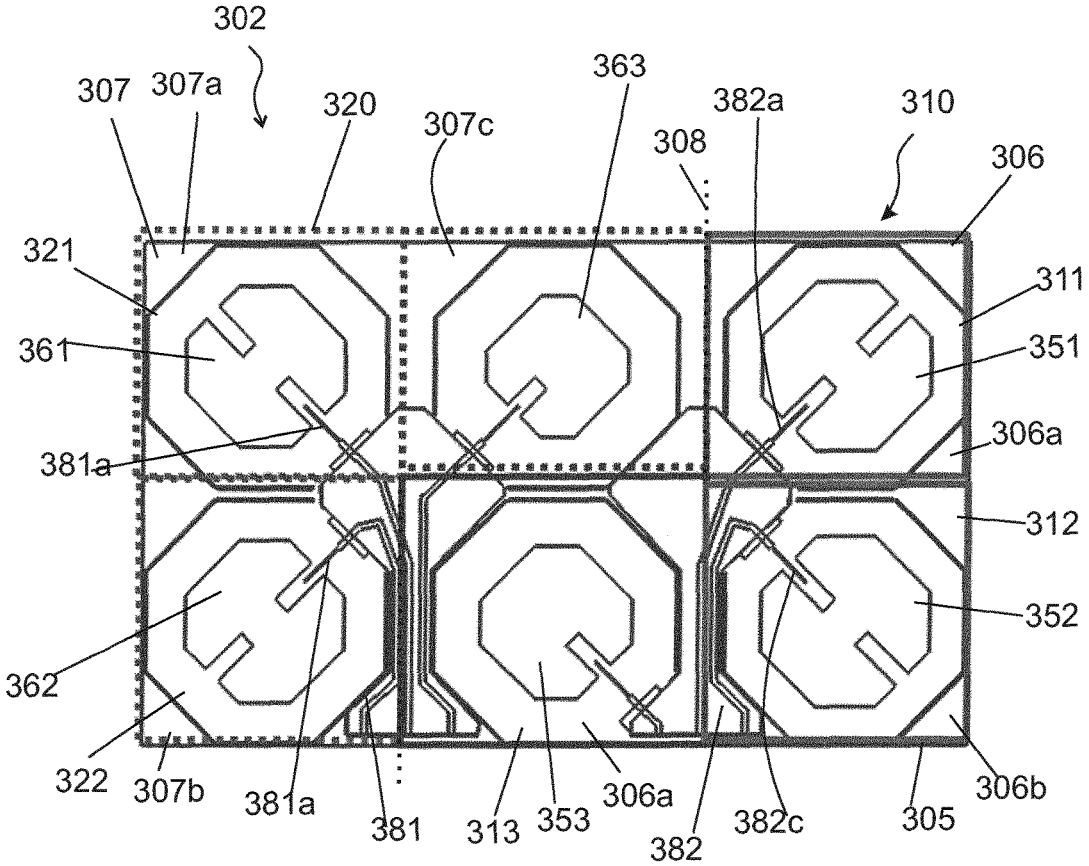
FIG. 4 shows an antenna device according to an aspect of the disclosure.

FIG. 2 shows an antenna device 202 whose antenna arrangement 201 is based on the principle of FIG. 1 and FIG. 3 shows the assembled antenna device 202 in a perspective view.

The antenna device 202 comprises an antenna support 205, preferably in the form of a PCB, which is divided into a first support area 206 and a second adjacent support area 207 and is separated by a separation line 208. The separation line 208 is M-shaped, and in the embodiment of FIG. 2, the separation line 208 separates the antenna support 205 into an upper section and a lower section. The first section support area 206 is the upper section and the second support area 207 is the lower section.

A transmitter section 210 is located in the first support area 206 and a receiver section 220 is located in the second support area 207.

The transmitter section comprises a first transmitter subsection 211—as an example of a first MIMO quadrant 211—located in a first (left on the figure) subsection 206*a* of the first support area 206 and a second transmitter subsection 212—as an example of a second MIMO quadrant 212—in a second (right on the figure) subsection 206*b*.

The first transmitter subsection 211 comprises a first transmitter patch antenna 251 for transmitting the telecommunication signals in a first frequency band BTx1 and a second transmitter patch antenna 252 for transmitting the telecommunication signals in a second frequency band BTx2.

The second transmitter subsection 212 comprises a third transmitter patch antenna 253 for transmitting the telecommunication signals in said first frequency band BTx1 and a fourth transmitter patch antenna 254 for transmitting the telecommunication signals in said second frequency band BTx2.

The first transmitter patch antenna 251 and the third transmitter patch antenna 253 are disposed respectively at upper outer lateral ends of the first subsection 206*a* and the second subsection 206*b*. The first transmitter patch antenna 251 is adapted to transmit signals in a first polarisation P1, whilst the third transmitter patch antenna 253 is adapted to transmit signals in a second polarisation P2. Although the embodiment of FIG. 2 uses patch antennas with +/−45° polarisations it should be understood that illustrated patch antennas are mere examples and that other polarisation orientations may be considered as well.

The first and second polarisation P1 and P2 of the telecommunications signals are linear and orthogonal to each other in this aspect of the disclosure.

The second transmitter patch antenna 252 and the fourth transmitter patch antenna 254 are disposed at the upper inner ends of the first subsection 206*a* and the second subsection 206*b*. The second transmitter patch antenna 252 is adapted to transmit the telecommunications signals at the first polarisation P1 whilst the fourth transmitter patch antenna 253 is adapted to transmit the telecommunications signals at the second polarisation P2.

A fifth transmitter patch antenna 255 is disposed adjacent to the second transmitter patch antenna 252 and to the fourth transmitter patch antenna 254, at the lower inner ends of the first subsection 206*a* and of the second subsection 206*b*, i.e. overlapping the first and second MIMO quadrants 211, 212. The second transmitter patch antenna 252 and the fourth transmitter patch antenna 254 are disposed face to face to each other, with respect to an (imaginary) centre vertical line L crossing the third transmitter patch antenna 255. The first transmitter patch antenna 251 and the third transmitter patch antenna 253 are disposed face to face to each other with respect to said centre vertical line L. The patch antenna positioned face to face with respect to said centre vertical line L may be symmetrically.

The fifth transmitter patch antenna 255 is adapted to transmit the telecommunications signals in a third transmitter frequency band BTx3 in one of the two polarisations P1 and P2. In the example of FIG. 2, the fifth transmitter patch antenna 255 is adapted to transmit the telecommunications signals in the first polarisation P1. The third transmitter frequency band BTx3 is of a higher frequency than the first transmitter frequency band BTx1 and at a lower frequency than the second transmitter frequency band BTx2.

The lower support section 207 supports the receiver section.

The receiver section comprises a first receiver subsection 221—as an example of a third MIMO quadrant 221—located in a first (left on the figure) subsection 207*a* of the first support area 207, facing the first upper subsection 206*a*, and a second receiver subsection 222—as an example of a fourth MIMO quadrant 222—in a second (right on the figure) subsection 207*b*, facing the second upper subsection 207*b*.

Although the illustrated embodiment is based on a MIMO configuration, it will be appreciated that the invention is not restricted thereto. The principal exposed in this disclosure of considering as design parameters a physical distance, frequency distance and polarisation may equally result in the same beneficial configuration without satisfying the MIMO criteria.

The first receiver subsection 221 comprises a first receiver patch antenna 261 for receiving the telecommunication signals in a second frequency band BRx2 and a second receiver patch antenna 262 for receiving the telecommunication signals in a first frequency band BRx1. The first receiver patch antenna 261 is located at a lower outer end of the first support section 207*a*, and the second receiver patch antenna 262 is located at an upper inner end of the first support section 207*a*.

The second receiver subsection 222 comprises a third receiver patch antenna 263 for receiving the telecommunication signals in said second frequency band BRx2 and a fourth receiver patch antenna 264 for receiving the telecommunication signals in said first frequency band BRx1.

The first receiver patch antenna 261 and the third receiver patch antenna 263 are disposed at the lower outer lateral ends of the first lower subsection 207*a* and the second lower subsection 207*b*, respectively. The first receiver patch antenna 261 is adapted to receive the telecommunications signals in the second polarisation P2 whilst the third receiver patch antenna 263 is adapted to receive the telecommunications signals in the first polarisation P1.

The second receiver patch antenna 262 and the fourth receiver patch antenna 264 are disposed at upper inner ends of the first subsection 207*a* and the second subsection 207*b*. The second receiver patch antenna 262 is adapted to receive the telecommunications signals in the second polarisation P2 whilst the fourth receiver patch antenna 264 is adapted to receive the telecommunications signals in the first polarisation P1.

A fifth receiver patch antenna 265 is disposed adjacent to the second receiver patch antenna 262 and to the fourth receiver patch antenna 264, at the lower inner ends of the first subsection 206*a* and of the second subsection 206*b*.

The second receiver patch antenna 262 and the fourth receiver patch antenna 264 are disposed face to face to each other with respect to the (imaginary) centre vertical line L crossing the fifth receiver patch antenna 265. The first receiver patch antenna 261 and the third receiver patch antenna 263 are disposed symmetrically to each other with respect to said centre vertical line L.

The fifth receiver patch antenna 265 is adapted to receive signals in a third frequency band BRx3 in one of the two polarisations P1 and P2. In the example illustrated, the fifth receiver patch antenna 265 is adapted to work in the second polarisation P2. The third receiver frequency band BRx3 is at a higher frequency than the first receiver frequency band BRx1 and at a lower frequency than the second receiver frequency band BRx2.

The receiver patch antennas are examples of the receiver means and the transmitter patch antennas are example of the transmitter means.

In other words, the first transmitter subsection (first MIMO quadrant 211) faces the first receiver subsection (third MIMO quadrant 221) for the transmission of the telecommunication signals in the first polarisation P1 and the reception of the telecommunication signals in the second polarisation P2, in both of the first and second frequency ranges BTx1, BTx2, BRx1, BRx2. Similarly, the second transmitter subsection (second MIMO quadrant 212) faces the second receiver subsection (fourth MIMO quadrant 222) for the reception of the telecommunication signals in the first polarisation P1 and the transmission of the telecommunication signals in the second polarisation P2, both in the first and second frequency ranges BTx1, BTx2, BRx1, BRx2.

The example of FIGS. 2 and 3 shows a triple band antenna device with the first and second receiver subsections 221, 222, and the first and second transmitter subsections 211, 212. However, this is not limiting the invention and a multiband antenna device handling more than three frequency bands can be implemented. The first and second receiver subsections 221, 222, and the first and second transmitter subsections 211, 212, can be arranged to have receiver means and transmitter means for handling more than two frequency ranges. This can be done by adding more radiator elements into the subsections 211, 212 and 221, 222.

Similarly, in the example shown in FIGS. 2 and 3, the two receiver means in the two receiver subsections 221 and 222 each comprise two patch antennas 261, 262 and 263, 264. The two receiver means are adapted to receive the same first and second frequency bands. However this is not limiting the invention. A first one of the receiver means (for example left on the figure) could receive a first and a second frequency band, whilst the other one of the receiver means could receive other frequency bands, which are different from the first and second frequency bands.

Similarly, the transmitter means could also be adapted to transmit four different transmitter frequency bands instead of having two transmitter means with two patch antennas 251, 252 and 253, 254 transmitting the same first and second transmitter frequency bands.

With this arrangement, for same frequency bands or for different frequency bands, a receiver subsection adjacent to a transmitter subsection are arranged in two orthogonal orientations with respect to the polarisation, for providing the telecommunication signals with the two orthogonal polarisations. This arrangement decouples the telecommunication signals received in the two adjacent receiver subsections, the telecommunications signals transmitted in two adjacent transmitter subsections, and of the received signal and transmitted telecommunications signal in two adjacent receiver subsection and transmitter subsections.

The fifth receiver patch antenna 265 and the fifth transmitter patch antenna 255 ensure physical and electrical separation of the other receiver patch antennas 261, 262 and 263, 264 and the other transmitter patch antennas 251, 252 and 253 and 254 supporting at least two different frequency bands.

The convention is that mobile phone uplink (UL) frequencies for the telecommunications signals correspond to base station receiver (Rx) frequencies. The first receiving band BRx1 is in the range of 1710-1785 MHz and the first transmitting band BTx1 is in the range of 1805-1880 MHz.

The second receiving band BRx2 is in the range of 2500-2570 MHz and the second transmitting band BTx2 is in the range 2620-2690 MHz. The third receiving band BRx3 is in the range of 1920-1980 MHz and the third transmitting band BTx3 is in the range 2110-2170 MHz.

The antenna device 202 of FIGS. 2 and 3 comprises single band antennas in the form of patch antennas, which are arranged closely to each other and are fed by a micro strip transmission line (not shown) on the PCB. As will be described later, dipole antennas may also be used instead of the patch antennas. Alternatively, the antennas and the feeding lines can be implemented by using air microstrip techniques or any other transmission line technique out of the known art. This invention is not limited to the used transmission line technique.

A very compact design may be achieved with the antenna device 202 of this description. The antenna device 202 can have, in one embodiment, a width of about 170 mm and a length of 320 mm.

Figure 5A:
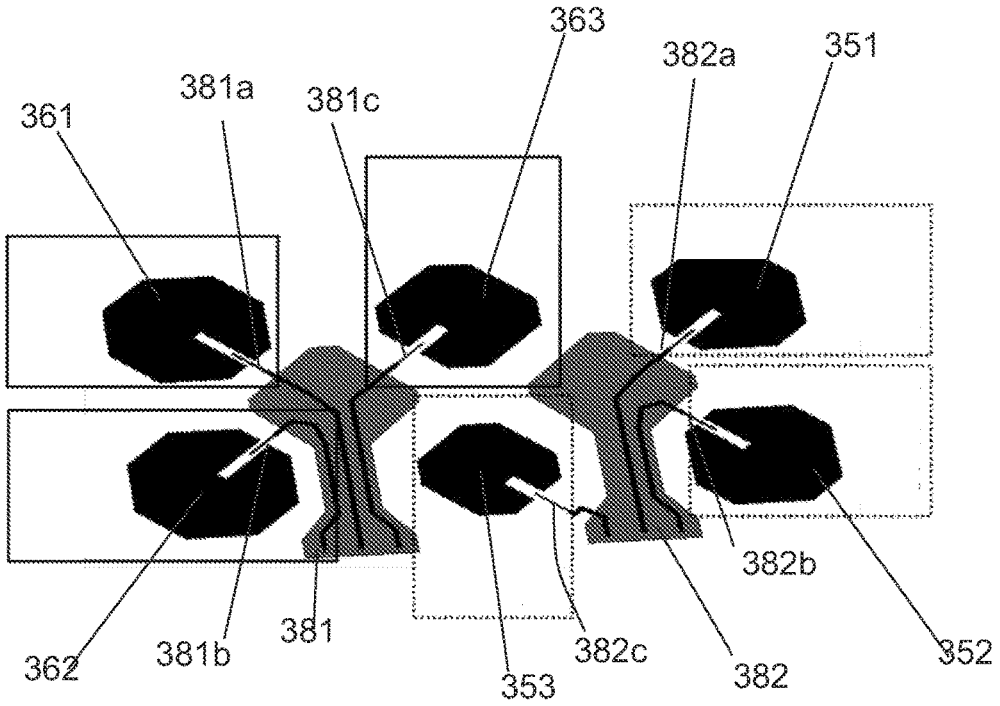
FIG. 5*a* shows a PCB with the top and bottom metallisation, according to an aspect of the disclosure
Figure 5B:
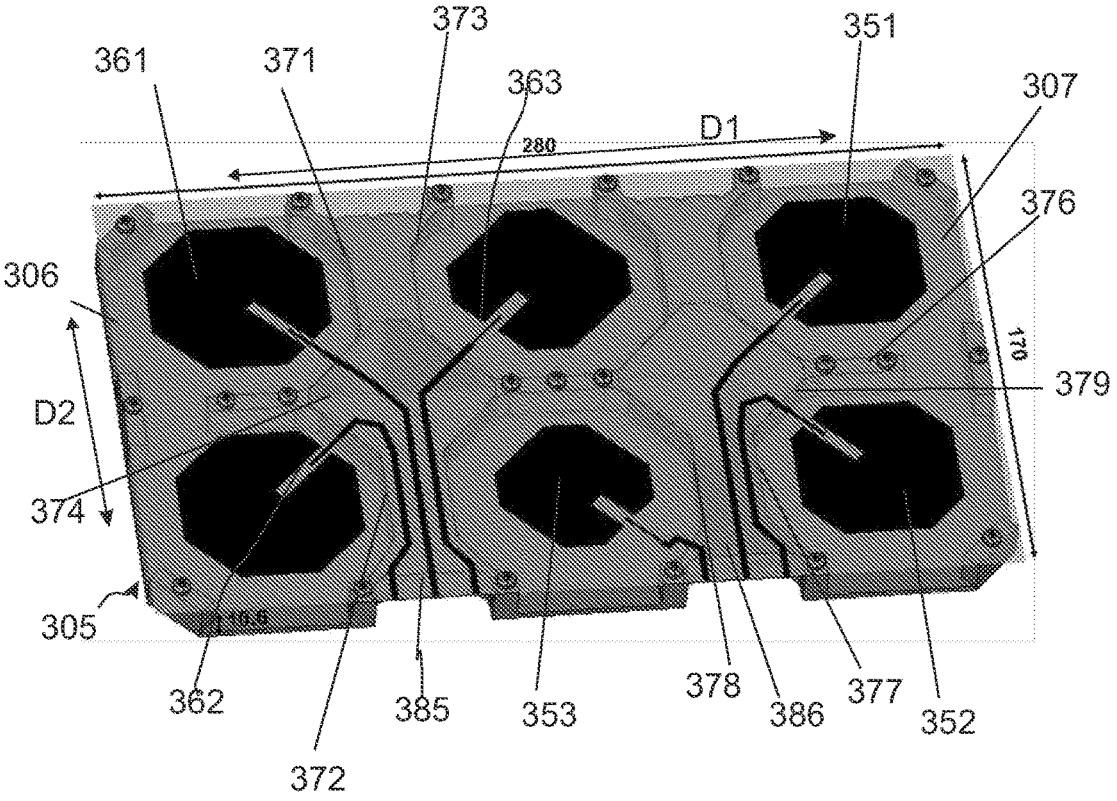
FIG. 5*b* shows the PCB antenna of FIG. 5*a* similar to the antenna device of FIG. 4, mounted on a reflector, according to an aspect of the disclosure.

FIG. 4 shows another example of antenna device 302 and FIGS. 5*a* and 5*b* show the physical arrangement of an antenna device similar to the antenna device of FIG. 4.

The antenna device 302 comprises an antenna support 305 preferably in the form of a PCB. The antenna device 302 is divided into in a first support area 306 and a second adjacent support area 307, which are separated by an (imaginary) separation line 308. The separation line 308 forms a step that separates the antenna support 305 into an upper left section (on the figure) and a lower right section, whereby the two sections are two interlocked L-shaped sections.

A first transmitter section 310 is located in the first support area 306 and a first receiver section 320 is located in the second support area 307.

The first transmitter section 310 comprises a first transmitter subsection 311 located in a first (upper right on the figure) subsection 306*a* of the first support area 306. The first transmitter subsection 311 comprises a first dual-band transmitter radiator 351 for transmitting the telecommunication signals in a first frequency band BTx1 and in a second frequency band BTx2 at a first polarisation P1.

The first transmitter section 310 comprises a second transmitter subsection 312 located in a second (lower right on the figure) subsection 306*b* of the first support area 306. The second transmitter subsection 312 comprises a second dual-band transmitter radiator 352 for transmitting the telecommunication signals in said first and second transmitter frequency bands BTx1, BTx2, but at a second polarisation P2.

A third transmitter radiator 353 for transmitting the telecommunication signals in a third transmitter frequency band BTx3 is located in a third (lower central on the figure) subsection 306*c* of the first support area 306. The third transmitter radiator 353 is adapted to transmit the telecommunications signals in the second polarisation P2.

The first and second polarisation P1 and P2 are linear and orthogonal to each other in this aspect of the disclosure. Preferably the first and second polarisations P1 and P2 are +/−45°.

The first transmitter section 310 further comprises a first reflector section 376 partly surrounding the first dual-band transmitter radiator 351, furthermore a second reflector section 377 partly surrounding the second dual-band transmitter radiator 352, and a third reflector section 377 partly surrounding the third transmitter radiator 353 (see FIGS. 5*a* and 5*b*).

As seen on the figures, the first, second and third reflector sections 376, 377, 378 are connected together or are manufactured in one piece, like a milled or casted part, and form collectively a transmitter reflector 379.

The L shaped upper left support section 307 supports the receiver section 320.

The receiver section 320 comprises a first receiver subsection 321 located in a first (upper left on the figure) subsection 307*a* of the second support area 307. The first receiver subsection 321 comprises a first dual-band receiver radiator 361 for receiving the telecommunication signals in the first frequency band BRx1 and in the second frequency band BRx2 at the second polarisation P2.

The receiver section 320 comprises a second receiver subsection 322 located in a second (lower left on the figure) subsection 307*b* of the second support area 307. The second receiver subsection 322 comprises a second dual-band receiver radiator 362 for receiving the telecommunication signals in said first and second frequency bands BRx1, BRx2, but at said first polarisation P1.

A third receiver radiator 363 for receiving telecommunication signals in said third frequency band BRx3 is located in a third (upper central on the figure) subsection 307*c* of the second support area 307. The third receiver radiator 363 is adapted to receive telecommunication signals at the first polarisation P1.

In other words, the first receiver radiator 361 is adjacent to the second receiver radiator 362 for the reception of the telecommunication signals in the first polarisation P1 and in the second polarisation P2 in both a first and second frequency ranges BRx1 and BRx2. The first transmitter radiator 351 is adjacent to the second transmitter radiator 352 for the transmission of the telecommunication signals at the first polarisation P1 and at the second polarisation P2 both in the first and second frequency ranges BTx1 and BTx2.

The receiver section 320 further comprises a fourth reflector section 371 to cooperate with the first dual-band receiver radiator 361, a fifth reflector section 372 to cooperate with the second dual-band receiver radiator 362, and a sixth reflector section 373 to cooperate with the third receiver radiator 363 (FIGS. 5*a* and 5*b*)

As seen on the figures, the fourth, fifth and seventh reflector sections 371, 372, 373 are connected together or are manufactured in one piece, like a milled or casted part, and form one receiver reflector 374. Preferably all reflector sections of the receiving and transmitting sections are manufactured in one piece, like a milled or casted part.

Similarly, the transmitter reflector 379 and the receiver reflector 374 share reflector elements to form respectively the reflectors of the third transmitter radiator 353 and of the third receiver radiator 363.

In other words, each of the transmitter radiators and the associated reflector section form a transmitter sub-antenna, and each of the receiver radiators and associated reflector section form a receiver sub-antenna.

The first receiving band BRx1 is in the range of 1710-1785 MHz and the first transmitting band BTx1 is in the range of 1805-1880 MHz.

The second receiving band BRx2 is in the range of 2500-2570 MHz and the second transmitting band BTx2 is in the range 2620-2690 MHz. The third receiving band BRx3 is in the range of 1920-1980 MHz and the third transmitting band BTx3 is in the range 2110-2170 MHz.

The different telecommunication signals of the multiband antenna device are decoupled between each other by the use of the two different polarisations P1 and P2, by the physical separation of the receiver and transmitter sections and by the use of different frequency ranges.

As can be seen on FIGS. 4 and 5*a*-5*b*, the receiver radiators are fed by a receiver microstrip line feeding network 381 on a substrate with top and bottom metallizations. Three lines 381*a*, 381*b*, 381*c* feeding respectively the corresponding first, second and third receiver radiators 361, 362, 363. Similarly the transmitter radiators are fed by a transmitter microstrip line feeding network 382 on a PCB with the top and bottom metallization. Three lines 382*a*, 382*b*, 382*c*, feeding respectively the corresponding first, second and third transmitter radiators 351, 352, 353

The top layer and the bottom layer of the PCB have a relative permittivity of 3.2 and a height of 0.79 mm. Other dimensions of the PCB are also possible.

As best seen on FIG. 5*b*, the receiver reflector 375 works as antenna reflector, but also as a microstrip line ground 385. Similarly, the transmitter reflector 376 works as an antenna reflector, but also as a microstrip line ground 386. In this case, there is no bottom metallization at the PCB.

It is noted that the reflector shape and geometry and the radiator shape and geometry can be arbitrary as long as the reflector works as both, the antenna reflector and the ground of the receiving feeding line 385 and the ground of the transmitting feeding line 386. For example, FIG. 4 shows a symmetric reflector and FIG. 5 shows an asymmetric reflector. A symmetric reflector means that the distance between reflector ground and the radiator and the distance between the feeding line ground and the feeding line is equal. An asymmetric reflector means that the distance between reflector ground and radiator and the distance between the feeding line ground and the feeding line is unequal.

The antenna of FIGS. 4 and 5*a*, 5*b* has a small dimension with a width of about 170 mm, a length of about 280 mm, and a height of 15 mm. The skilled person will therefore appreciate the very small height reduction in comparison to prior art antenna means.

One aspect of the antenna arrangement is the specific matching of the respective receiver and/or transmitter radiators. The present inventors have found out that, for the respective frequency bands, the receiver and transmitter radiators should be matched intraband-specific. In other words, the radiators are matched in that way that the respective bandwidths covering one or more corresponding receiving bands, or transmitter bands, but not both. This matching can be done by changing the dimensions of the radiators or of the feeding lines or by changing the environment of the radiators.

In the example of FIGS. 4 and 5, the first receive radiator 361 and the second receive radiator 362 are matched to the lowest receive frequency band (BRx1, 1710-1785 MHz) as well as to the higher receive frequency band (BRx2, 2500-2700 MHz) as well as being unmatched in the second lowest receive frequency band (BRx3, 1920-1980 MHz). The first transmitter radiator 351 and the second transmitter radiator 352 are matched to the lowest transmit frequency band (BTx1, 1805-1880 MHz) as well as to the higher transmit frequency band (BTx2, 2500-2700 MHz) as well as being unmatched in the second lowest receive frequency band (BTx3, 2110-2170 MHz).

The spatial separation between the receiver and transmitter means is also critical. As can be seen on FIG. 5*b*, a distance D1 between an orthogonal polarised dual band receiver radiator or sub antenna, and the dual band transmitter radiator, for the same or similar bands, should be at least equal to the dimension of one respective sub antenna, especially the dimension of the radiator. The points of reference for defining the difference should be centre of the respective sub antennas, especially the centre of the radiators.

Similarly, a distance D2 between two orthogonally polarized receiver radiators or sub-antenna means should be at least equal to the dimension of one respective sub antenna, especially the dimension of the radiator. The points of reference for defining the difference should be the centre of the respective sub antennas, especially the centre of the radiators. One preferred embodiment discloses a distance of 80 mm between the antennas of different polarisation, to give an isolation of better than 20 dB on a given radiator or sub antenna configuration. This is a non limiting example.

FIGS. 4 and 5 illustrate dual-band antennas which can be also used for MIMO functionality, disclosing a more compact design. These dual band antennas can also be replaced by two narrowband antennas. By providing this the respective frequency bands can be diplexed with filters that have no high selectivity and hence low insertion loss. This benefit is also disclosed by using the aforementioned dual band antennas and diplexing frequency bands with the biggest frequency gap between each other as possible. These filters can also be implemented in the multiband antenna device, preferably implemented on the PCB.

Figure 6:
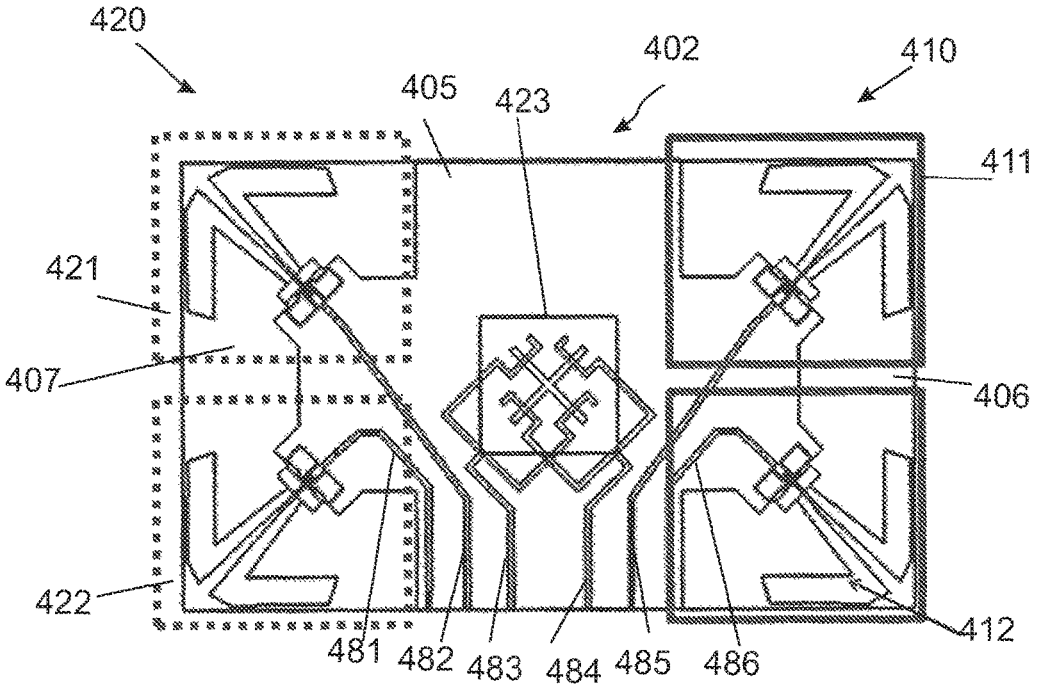
FIG. 6 shows an antenna device according to an aspect of the disclosure.
Figure 7:
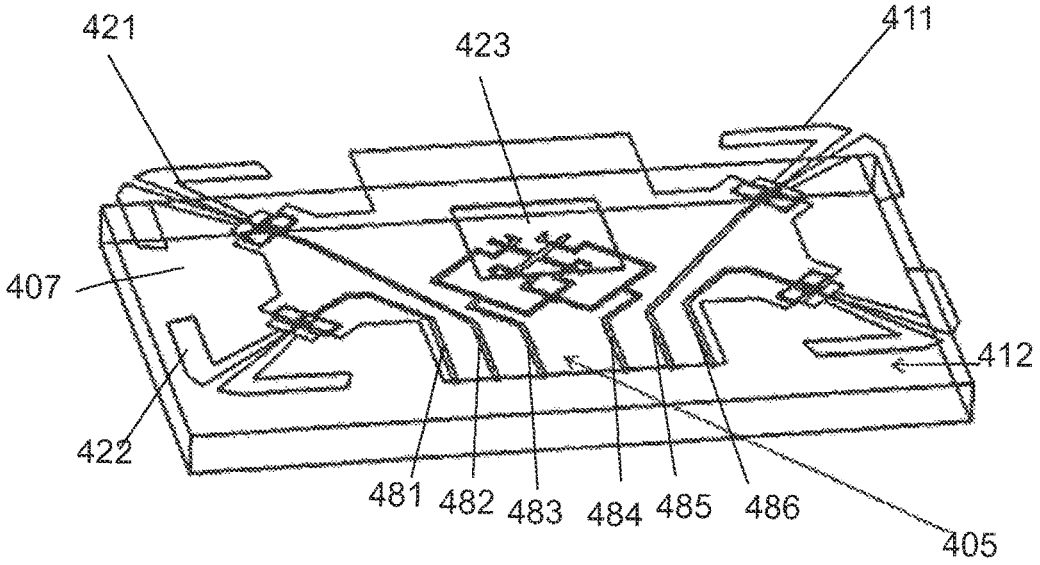
FIG. 7 shows the antenna device mounted on a PCB of FIG. 6, according to an aspect of the disclosure

FIG. 6 shows another example of the antenna device 402 and FIG. 7 shows the antenna device 402 of FIG. 6 in a perspective view.

The antenna device 402 comprises an antenna support 405 in the form of a PCB for example, which is divided into a transmitter section 410 and a receiver section 420. The transmitter section 410 is located in a first support area 406 (right side on the figure) and the receiver section 420 is located in the second support area 407 (left side on the figure).

The transmitter section 410 comprises a first dual band transmitter dipole antenna 411 located in a first area (upper right on the figure) of the first support area 406. The first dual band transmitter dipole antenna 411 is adapted for transmitting telecommunication signals in a first frequency band BTx1 and in a second frequency hand BTx2 at a first polarisation P1.

The transmitter section 410 comprises a second dual band transmitter dipole antenna 412 located in a second area (lower right on the figure) of the first support area 406. The second dual band transmitter dipole antenna 412 is adapted for transmitting telecommunication signals in said first and second frequency bands BTx1, BTx2, but at a second polarisation P2.

The first and second polarisation P1 and P2 are linear and orthogonal to each other, and preferably +/−45°.

The receiver section 420 comprises a first dual band receiver dipole antenna 421 located in a first area (upper left on the figure) of the second support area 407 for receiving telecommunication signals in the first frequency band BRx1 and in the second frequency band BRx2 at the second polarisation P2.

The receiver section 420 comprises also a second dual band receiver dipole antenna 422 located in a second area (lower left on the figure) of the second support area 407 for receiving telecommunication signals in said first and second frequency bands BRx1, BRx2, but at said first polarisation P1.

With respect to the chosen frequency bands the first dual band receiver dipole antenna 421 and the second dual band receiver dipole antenna 422 can be used for a MIMO receiver for the reception of telecommunication signals having the first polarisation P1 and the second polarisation P2 and a spatial separation, what is beneficial for such a operation. Furthermore the MIMO operation can be used in two different frequency bands. The first dual band transmitter dipole antenna 411 is located adjacent to the second dual band transmitter dipole antenna 412 and is for the transmission of the telecommunication signals having the first polarisation P1 and the second polarisation P2, both in a first and second frequency ranges BTx1 and BTx2.

A dual polarised patch antenna 423 is arranged in a middle area of the antenna support 405 for receiving telecommunication signals in a third frequency band BRx3 and transmitting the telecommunication signals in a third frequency band BTx3 in two different polarisations.

The first band BRx1 is in the range of 1710-1785 MHz in reception and the first band BTx1 is in the range of 1805-1880 MHz in transmission.

The second band BRx2 is in the range of 2500-2570 MHz and BTx2 is in the range 2620-2690 MHz. The third band BRx3 is in the range of 1920-1980 MHz and BTx3 is in the range 2110-2170 MHz.

The antennas are fed by six micro strip feeding lines 481 to 486 on one side of the PCB support 405.

The decoupling of the antennas 411, 412, 421 and 422 of the multiband antenna device 402 is achieved by spatial separation and by the different polarisations of the telecommunication signals and by the separation of the different frequency bands.

Figure 8:
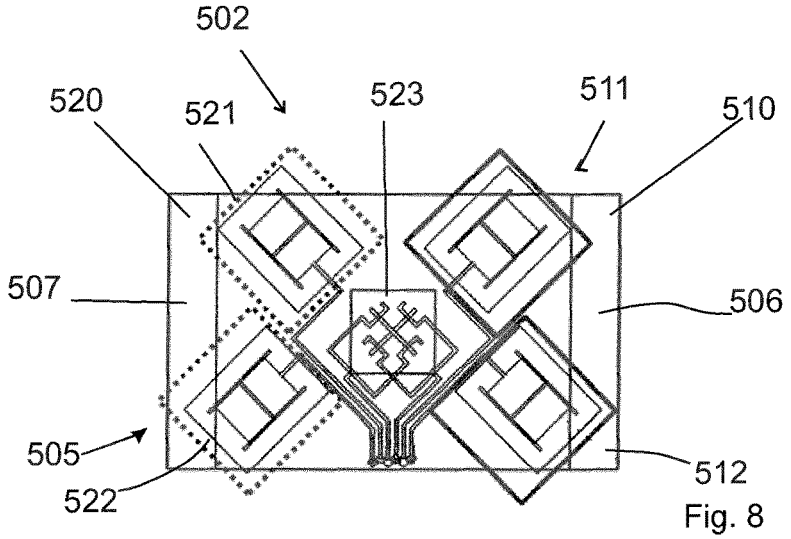
FIG. 8 shows an antenna device according to an aspect of the disclosure.
Figure 9:
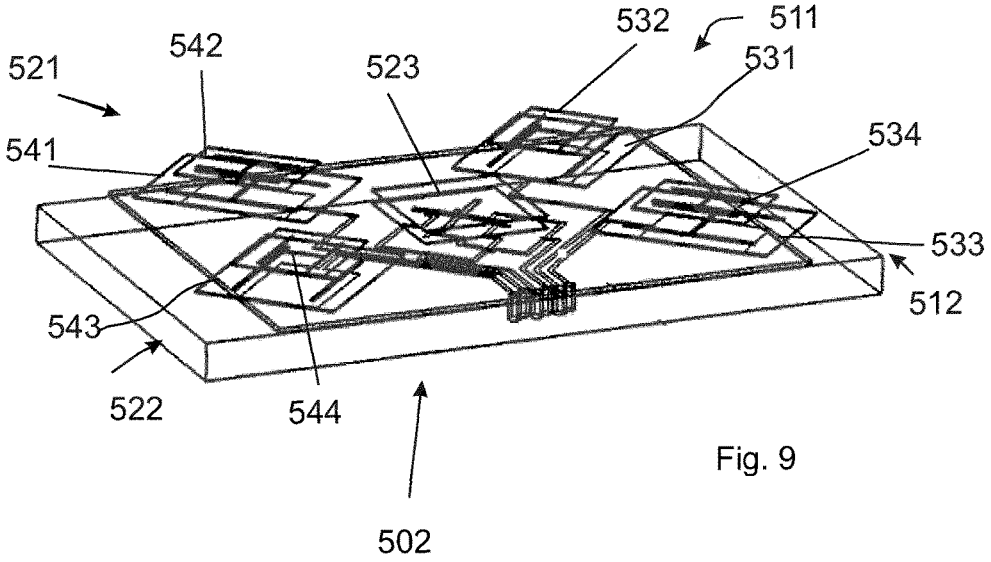
FIG. 9 shows the antenna device mounted on a PCB of FIG. 8, according to an aspect of the disclosure

FIG. 8 shows another example of antenna device 502 and FIG. 9 shows the antenna device 502 of FIG. 8 in a perspective view.

The antenna device 502 comprises an antenna support 505, which is in the form of a PCB and is divided into in a transmitter section 510 and a receiver section 520. The transmitter section 510 is located in a first support area 506 (right side on the figure) and the receiver section 520 is located in the second support area 507 (left side on the figure).

The transmitter section 510 comprises a first transmitter patch antenna section 511, which is located in a first area (upper right on the figure) of the first support area 506. The first transmitter patch antenna section 511 comprises a first transmitter patch antenna 531 for transmitting the telecommunication signals in a first frequency band BTx1 and a second transmitter patch antenna 532 for transmitting the telecommunication signals in a second frequency band BTx2. The second transmitter patch antenna 532 is stacked on the first transmitter patch antenna 531, as seen on FIG. 9.

The transmitter section 510 comprises a second transmitter patch antenna section 512 located in a second area (lower right on the figure) of the first support area 506. The second transmitter patch antenna section 512 comprises a third transmitter patch antenna 533 for transmitting the telecommunication signals in said first frequency band BTx1 and a fourth transmitter patch antenna 534 for transmitting telecommunication signals in said second frequency band BTx2. The fourth transmitter patch antenna 534 is stacked on the third transmitter patch antenna 533.

The first transmitter patch antenna section 511 is adapted for transmitting the telecommunication signals having a first polarisation P1, whilst the second transmitter patch antenna section 512 is adapted for transmitting the telecommunication signals using a second polarisation P2.

The first and second polarisations P1 and P2 are linear and orthogonal to each other and preferably +/−45°.

The receiver section 520 comprises a first receiver patch antenna section 521 located in a first area (upper left on the figure) of the second support area 507 for receiving the telecommunication signals in the first frequency band BRx1 and in the second frequency band BRx2 in the second polarisation P2.

The receiver section 520 comprises also a second receiver patch antenna section 522 located in a second area (lower left on the figure) of the second support area 307 for receiving telecommunication signals in said first and second frequency bands BRx1, BRx2, but in said first polarisation P1.

The first receiver patch antenna section 521 comprises a first receiver patch antenna 541 for receiving the telecommunication signals in said first frequency band BRx1 and a second receiver patch antenna 542 for receiving the telecommunication signals in said second frequency band BRx2. The second receiver patch antenna 542 is stacked on the first receiver patch antenna 541, as seen on FIG. 9. The second receiver patch antenna section 522 comprises a third receiver patch antenna 543 for receiving the telecommunication signals in said first frequency band BRx1 and a fourth receiver patch antenna 544 for receiving the telecommunication signals in said second frequency band BRx2. The fourth receiver patch antenna 544 is stacked on the third transmitter patch antenna 543.

In the middle section, a dual polarised patch antenna 523 is arranged in a middle area of the antenna support 505 for receiving the telecommunication signals in a third frequency band BRx3 and transmitting the telecommunication signals in a third frequency band BTx3 in two different polarisations.

In other words, the first dual band receiver patch antenna 521 and the second dual band receiver patch antenna 522 can be used for a MIMO receiver for the reception of the telecommunication signals in the first polarisation P1 and in the second polarisation P2, and a spatial separation, what is beneficial for such a operation. Furthermore the MIMO operation can be used in two different frequency bands. Similarly, the first dual band transmitter patch antenna 511 is located adjacent the second dual band transmitter patch antenna 352 and is for the transmission of the telecommunication signals in the first polarisation P1 and in the second polarisation P2, in both the first and second frequency ranges BTx1 and BTx2.

The PCB support 505 can comprise in another embodiment of the invention three layers. The first layer corresponds to the dual polarised patch antenna 523. The second layer supports the receiver and transmitter antennas of the first frequency bands BRx1, BTx1, and the third layer supporting the receiver and transmitter antennas of the second frequency bands BRx2, BTx2.

Figure 10:
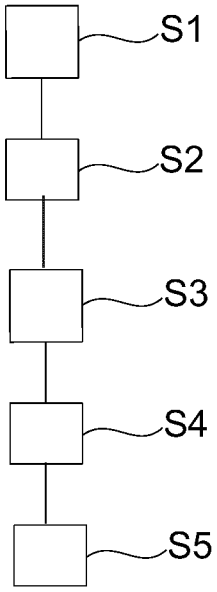
FIG. 10 shows a block diagram of a method for designing a multiband antenna device according to an aspect of the disclosure.

FIG. 10 shows a flow diagram of a method of arranging antenna device according to an aspect of the disclosure. The method is described with reference to the antenna device 202 of FIGS. 4 and 5 having dual band antenna elements.

In a first step S1 the PCB support is divided in at least first, second, third and fourth subsections (206*a*, 206*b*, 207*a*, 207*b*).

In a second step S2 the first receiver means is arranged in the first subsection 206*a* and is arranged to receive the telecommunications signals having the first polarisation P1. The second and fourth receiver means are arranged in the second support subsection to receive the telecommunications signals having said second polarisation P2. The third receiver means is arranged in a middle section on both the first and second subsections 206*a*, 206*b*.

In a third step S3 the first transmitter means are arranged in the third support subsection to transmit the telecommunications signals with the second polarisation P2, and the second transmitter means are arranged in the fourth subsection to transmit the telecommunications signals with said first polarisation P1. The third transmitter means for transmitting the telecommunications signals in a fifth transmitter frequency band are arranged in a middle section on both the third and fourth subsections 207*a*, 207*b*.

In a fourth step S4, the distance between the receiver means or the transmitter means for the telecommunications signals having the same polarisation is about the size of the receiver means or the transmitter means that radiate the telecommunications signals in the fifth transmitter frequency band.

In a fifth step S5, the one of the first or second receiver means operates in a receiver frequency band below the fifth receiver frequency band and the other of the first or second receiver means operates in a receiver frequency band above the fifth receiver band. One of the first or second transmitter means operates in a transmitter frequency band below the fifth transmitter frequency band and the other of the first or second transmitter means operates in a transmitter frequency band above the fifth transmitter frequency band.

The invention claimed is:

1. An antenna device comprising:

a mechanical support divided into at least first, second, third and fourth subsections, a plurality of receiver assemblies including at least a first receiver assembly with a first receiver antenna operating in at least a first receiver frequency band and a second receiver frequency band, a second receiver assembly with a second receiver antenna for operating in at least a third receiver frequency band and a fourth receiver frequency band, and a third receiver assembly with a third receiver antenna operating in a fifth receiver frequency band:

a plurality of transmitter assemblies including at least a first transmitter assembly with a first transmitter antenna operating in at least a first transmitter frequency band and a second transmitter frequency band, a second transmitter assembly with a second transmitter antenna operating in at least a third transmitter frequency band and a fourth transmitter frequency band, and a third transmitter assembly with a third transmitter antenna operating in a fifth transmitter frequency band, wherein the first receiver antenna is arranged in the first subsection and the first receiver antenna receives telecommunications signals having a first polarization, the second receiver antenna is arranged in the second subsection and the second receiver antenna receives telecommunications signals having a second polarization;

the first transmitter antenna is arranged in the third subsection and the first transmitter antenna transmits telecommunications signals having the second polarisation, and the second transmitter antenna is arranged in the fourth subsection and the second transmitter antenna transmits telecommunications signals having the first polarisation, wherein the third receiver antenna is arranged in two of the subsections selected from the first subsection, the second subsection, the third subsection and the fourth subsection, and the third transmitter antenna is arranged in the other two of the subsections selected from the first subsection, the second subsection, the third subsection and the fourth subsection, wherein the third receiver antenna is arranged to receive the telecommunications signals having the first polarization, and the third transmitter antenna is arranged to transmit telecommunications signals having the second polarization.

2. An antenna device according to claim 1, wherein the first and second polarisations are linear and orthogonal to each other.

3. An antenna device according to claim 1, wherein the first and second polarisations are at 45° to each other.

4. An antenna device according to claim 1, wherein the first receiver frequency band and the third receiver frequency band are the same and the second receiver frequency band and the fourth receiver frequency band are the same, and wherein the first transmitter frequency band and the third transmitter frequency band are the same and the second transmitter frequency band and the fourth transmitter frequency band are the same.

5. An antenna device according to claim 1, wherein the third receiver antenna is arranged in both the first and second subsections, and the third transmitter antenna is arranged in both the third and fourth subsections.

6. An antenna device according to claim 1, wherein the third receiver antenna is arranged in both the second and the fourth subsections, and the third transmitter antenna is arranged in both the first and the third subsections.

7. An antenna device according to claim 1, wherein the first and second receiver antennas comprise a dual band or multiband receive antenna operating in the same frequency bands, and/or the first and second transmitter antennas comprise a dual band or multiband transmit antenna operating in the same frequency bands.

8. An antenna device according to claim 1, wherein the first and second receiver antenna comprise a dual band receiver, and/or the first and second transmitter assemblies comprise a dual band transmitter.

9. An antenna device according to claim 1, wherein at least one of the first receiver antenna, the second receiver antenna, the first transmitter antenna and the second transmitter antenna comprise at least one of a dipole antenna or a patch antenna.

10. An antenna device according to claim 1, wherein the mechanical support comprises radiating elements forming radiators for the receiver assemblies and the transmitter assemblies, and wherein said radiators comprise further a plurality of feeding lines for feeding the plurality of the transmitter assemblies and the plurality of the receiver assemblies.

11. An antenna device according to claim 10, wherein the plurality of feeding lines comprises at least one of a micro strip transmission line on a PCB or an air micro strip transmission line.

12. An antenna device according to claim 10, wherein the radiators comprise at least one of a dual-band radiator or of a narrowband radiator.

13. An antenna device according to claim 1, wherein the first receiver frequency band is in the range of 1710-1785 MHz and the first transmitter frequency band is in the range of 1805-1880 MHz, the second receiver frequency band is in the range of 2500-2570 MHz and the second transmitter frequency band is in the range 2620-2690 MHz, the fifth receiver frequency band is in the range of 1920-1980 MHz and the fifth transmitter frequency band is in the range 2110-2170 MHz.

14. An antenna device according to claim 1, wherein each of the receiver assemblies and each of the transmitter assemblies comprise a narrowband antenna, wherein the first, second and third receiver frequency bands comprises a lowest receiver frequency band, a second lowest receiver frequency band and a plurality of higher receiver frequency bands, wherein the first, second and third transmitter frequency bands comprises a lowest transmitter frequency band, a second lowest transmitter frequency band and a plurality of higher transmitter frequency bands.

15. An antenna device according to claim 1, wherein a distance between two of the receiver assemblies or the transmitter assemblies with antennas relating the telecommunications signals having the same polarization in the subsections is the size of one of the receiver assemblies operating in the fifth receiver frequency band or the size of the transmitter assembly operating at the fifth transmitter frequency band.

16. An antenna device according to claim 1, wherein the mechanical support comprises a PCB.

17. An antenna device according to claim 16, wherein the PCB support is a multilayer PCB.

18. A method of manufacturing an antenna device comprising the steps of:

dividing a PCB support divided into at least first, second, third and fourth subsections, arranging a plurality of receiver assemblies including at least a first receiver assembly with a first receiver antenna for receiving telecommunications signals in at least a first receiver frequency band and a second receiver frequency band, a second receiver assembly with a second receiver antenna for receiving the telecommunications signals in at least a third receiver frequency band and a fourth receiver frequency band, and a third receiver assembly with a third receiver antenna for receiving telecommunications signals in a fifth receiver frequency band;

arranging a plurality of transmitter assemblies including at least a first transmitter assembly with a first transmitter antenna for transmitting telecommunications signals in at least a first transmitter frequency band and a second transmitter frequency band, a second transmitter assembly with a second transmitter antenna for transmitting telecommunications signals in at least a third transmitter frequency band and a fourth transmitter frequency band, and at least a third transmitter assembly with a third transmitter antenna operating in a fifth transmitter frequency band, wherein the first receiver antenna is arranged in the first subsection and the first receiver antenna is arranged to receive telecommunications signals having a first polarisation, the second receiver antenna is arranged in the second subsection and the second receiver antenna is arranged to receive telecommunications signals having a second polarization;

the first transmitter antenna is arranged in the third subsection and the first transmitter antenna is arranged to transmit telecommunications signals having said second polarisation, and the second transmitter antenna is arranged in the fourth subsection and the second transmitter antenna is arranged to transmit the telecommunications signals having said first polarisation, wherein the third receiver antenna is arranged in two of the subsections selected from the first subsection, the second subsection, the third subsection and the fourth subsection, and the third transmitter antenna is arranged in the other two of the subsections selected from the first subsection, the second subsection, the third subsection and the fourth subsection, and wherein the third receiver antenna is arranged to receive the telecommunications signals having the first polarization, and the third transmitter antenna is arranged to transmit telecommunications signals having the second polarization.

19. A method according to claim 18, wherein the first receiver frequency band and the third receiver frequency band are the same and the second receiver frequency band and the fourth receiver frequency band are the same, and wherein the first transmitter frequency band and the third transmitter frequency band arc the same and the second transmitter frequency band and the fourth transmitter frequency band are the same.

20. A method according to claim 18, wherein each of the receiver antennas and each of the transmitter antennas comprises a narrowband antenna, wherein, for transmitter antennas located in only one subsection, the first, second and third receiver frequency bands comprise a lowest receiver frequency band, a second lowest receiver frequency band and a plurality of higher receiver frequency bands, and wherein the first, second and third transmitter frequency bands comprise a lowest transmitter frequency band, a second lowest transmitter frequency band and a plurality of higher transmitter frequency bands.

21. A method according to claim 18, comprising adjusting a distance between the receiver assemblies or the transmitter assemblies having antennas with the telecommunications of the same polarization in the subsections to a distance the size of one of the receiver assmeblies operating in the fifth receiver frequency band or the transmitter assembly operating in the fifth transmitter frequency band.

* * * * *